US011525100B2

(12) United States Patent
Dai et al.

(10) Patent No.: US 11,525,100 B2
(45) Date of Patent: Dec. 13, 2022

(54) BIODEGRADABLE FLUIDS

(71) Applicant: Petro-Canada Lubricants Inc., Mississauga (CA)

(72) Inventors: Cecelia Dai, Mississauga (CA); Vittoria Lopopolo, Mississauga (CA); Atieh Ghadiri, Mississauga (CA); Doug Irvine, Mississauga (CA)

(73) Assignee: PETRO-CANADA LUBRICANTS INC., Ontario (CA)

( * ) Notice: Subject to any disclaimer, the term of this patent is extended or adjusted under 35 U.S.C. 154(b) by 0 days.

(21) Appl. No.: 17/364,977

(22) Filed: Jul. 1, 2021

(65) Prior Publication Data

US 2022/0002630 A1 Jan. 6, 2022

Related U.S. Application Data

(60) Provisional application No. 63/046,988, filed on Jul. 1, 2020.

(51) Int. Cl.

| | |
|---|---|
| ***C10M 169/02*** | (2006.01) |
| ***C10M 105/04*** | (2006.01) |
| ***C10M 119/12*** | (2006.01) |
| *C10N 30/02* | (2006.01) |
| *C10N 20/00* | (2006.01) |
| *C10N 40/08* | (2006.01) |

(52) U.S. Cl.

CPC ..... *C10M 169/02* (2013.01); *C10M 105/04* (2013.01); *C10M 119/12* (2013.01); *C10M 2203/1025* (2013.01); *C10M 2209/084* (2013.01); *C10N 2020/081* (2020.05); *C10N 2030/02* (2013.01); *C10N 2040/08* (2013.01)

(58) Field of Classification Search

CPC ..... C10M 169/02; C10M 105/04; C10M 119/12; C10M 2203/1025; C10M 2209/084; C10N 2020/081; C10N 2030/02; C10N 2040/08

See application file for complete search history.

(56) References Cited

U.S. PATENT DOCUMENTS

| | | | | |
|---|---|---|---|---|
| 2003/0186824 | A1* | 10/2003 | Chiu | C10M 169/04 508/496 |
| 2007/0259792 | A1* | 11/2007 | Null | C10M 169/041 508/583 |
| 2008/0015400 | A1* | 1/2008 | Matsui | C10M 109/02 585/1 |
| 2009/0005273 | A1* | 1/2009 | Swartele | C10M 171/02 508/110 |
| 2009/0005274 | A1* | 1/2009 | Swartele | C10M 177/00 508/110 |
| 2009/0137435 | A1* | 5/2009 | Hilker | C10M 171/02 508/281 |
| 2010/0016195 | A1* | 1/2010 | Shirahama | C10M 101/02 508/567 |

(Continued)

*Primary Examiner* — Ellen M McAvoy
(74) *Attorney, Agent, or Firm* — Jackson Walker LLP

(57) ABSTRACT

The incorporation of highly refined, low viscosity index base oils along with a polymeric thickener produces a final readily biodegradable fluid with a significantly high viscosity. The present invention allows the formulation of a high viscosity readily biodegradable fluid where the vast majority of the fluid is mineral oil. Previous uses of mineral oils only allowed for formulation of substantially lower viscosity readily biodegradable fluids.

10 Claims, 1 Drawing Sheet

(56) References Cited

U.S. PATENT DOCUMENTS

| | | | | |
|---|---|---|---|---|
| 2010/0035777 | A1* | 2/2010 | Sano | C10M 101/02 208/18 |
| 2010/0041572 | A1* | 2/2010 | Sano | C10M 101/02 508/564 |
| 2010/0130395 | A1* | 5/2010 | Tagawa | C10M 101/02 508/552 |
| 2011/0065618 | A1* | 3/2011 | Tagawa | C10M 171/02 508/382 |
| 2011/0230685 | A1* | 9/2011 | Tagawa | C10M 101/02 585/734 |
| 2012/0010113 | A1* | 1/2012 | Hee | C10M 111/04 508/400 |
| 2015/0060327 | A1* | 3/2015 | Tagawa | C10M 177/00 208/18 |
| 2015/0060328 | A1* | 3/2015 | Tagawa | C10M 171/02 208/18 |
| 2015/0364229 | A1* | 12/2015 | Singha | H01B 17/34 252/570 |

* cited by examiner

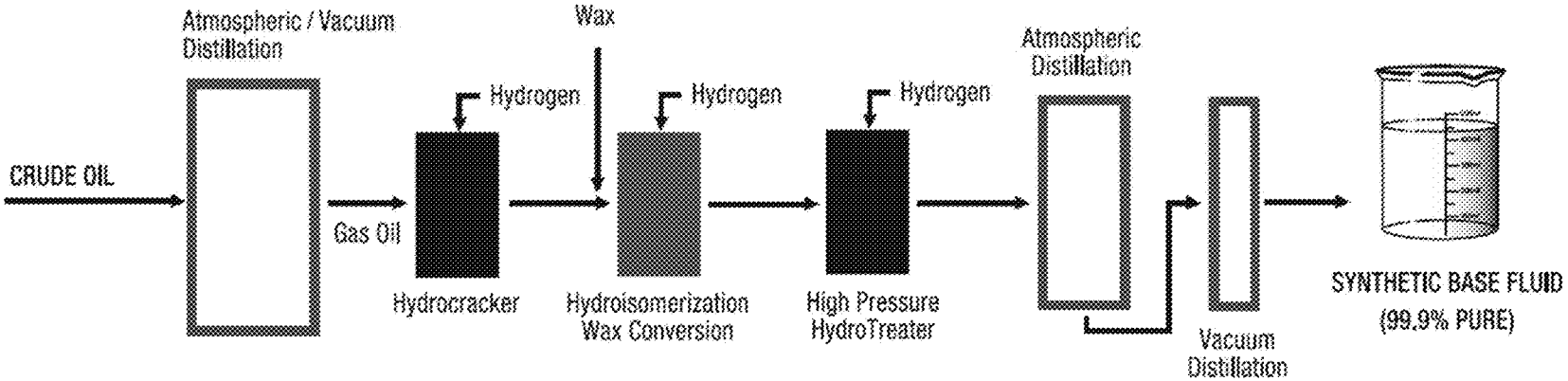
CRUDE OIL
Atmospheric / Vacuum Distillation
Gas Oil
Hydrogen
Hydrocracker
Wax
Hydrogen
Hydroisomerization Wax Conversion
Hydrogen
High Pressure HydroTreater
Atmospheric Distillation
Vacuum Distillation
SYNTHETIC BASE FLUID (99.9% PURE)

BIODEGRADABLE FLUIDS

This application claims priority to U.S. Provisional Patent Application Ser. No. 63/046,988, entitled "Biodegradable Fluids," filed Jul. 1, 2020, the entire contents of which are incorporated by reference herein.

BACKGROUND

The present disclosure relates to biodegradable fluids, including readily biodegradable industrial or hydraulic fluids having high viscosities.

The biodegradability of organic fluids used in environmentally sensitive areas is important in case of spill or other release of the fluid into the environment. Organic fluids can be significantly toxic to both terrestrial and aquatic organisms. Organic fluids which are readily biodegradable, breakdown rapidly in the environment and are non-persistent, posing reduced risk to the environment and living organisms.

Generally, biodegradation is the process by which organic substances are decomposed by micro-organisms (mainly aerobic bacteria) into simpler substances such as carbon dioxide, water and ammonia. Biodegradation is unique in that the end result is often the complete conversion of the organic substance to inorganic products (e.g., carbon dioxide and water).

A series of laboratory screening tests have been developed for determining the "ready" and "inherent" biodegradability of organic compounds. Degradation in such tests is often monitored by measuring loss of dissolved organic carbon, oxygen consumption (biological oxygen demand) or formation of carbon dioxide, such that these screening tests can be applicable to a broad range of organic substances. "Ready" biodegradability is determined under the most stringent of test conditions, using a very small amount of microbial inoculum, where the test chemical is present as the sole carbon source at low concentrations. Chemicals that are shown to pass a ready biodegradability test also rapidly degrade in wastewater treatment plants and in the natural environment. "Inherent" biodegradability tests are intended to provide more favorable conditions for biodegradation to occur. These tests may be conducted using higher microbial inoculum concentrations, higher test chemical concentrations, and conditions which allow for acclimation of the microorganisms. Chemicals that pass an inherent biodegradability test are considered non-persistent, although the breakdown of the chemical in the environment may be slow.

Traditionally, readily biodegradable hydraulic fluids have been formulated using vegetable oils, and synthetic esters made from saturated and unsaturated carboxylic acids. Esters, as a whole, typically offer high levels of biodegradability and come in a wide range of viscosities, which are suitable for blending commonly used viscosity grades of hydraulic fluids.

Ester based hydraulic fluids generally offer good lubricity and wear protection, but can suffer some disadvantages in comparison to common mineral oil based hydraulic fluids. These disadvantages include higher cost, aggressiveness toward seals, and poor hydrolytic stability. In some cases, these esters suffer from poor oxidative stability and low temperature flow performance. While making excellent hydraulic fluids, and widely used as such in industry, mineral oils typically do not provide high levels of biodegradability, especially in the viscosity ranges common to hydraulic fluids. A readily biodegradable mineral oil based hydraulic fluid would offer the high performance of a traditional industrial hydraulic fluid along with the low environmental impact of an ester.

SUMMARY

The present disclosure pertains to biodegradable fluids and methods for preparing such fluids. In particular, the present disclosure pertains to biodegradable mineral oil based industrial or hydraulic fluids.

Mineral oil based hydraulic fluids typically have low levels of biodegradability, restricting their use in environmentally sensitive areas. Existing readily biodegradable hydraulic fluids are largely based on higher cost esters and other synthetic fluids. Some of these higher cost options also have significant performance disadvantages such as poor hydrolytic stability (i.e. they degrade in the presence of water), poor oxidative stability, and poor low temperature stability.

The readily biodegradable fluids described herein use mineral oils without the need to incorporate esters or other highly biodegradable natural or synthetic fluids. Preferred embodiments include high viscosity mineral oil based fluids that are readily biodegradable. Previous uses of mineral oils only allowed for formulation of substantially lower viscosity readily biodegradable fluids.

As described herein with regard to preferred embodiments, the incorporation of highly refined, high viscosity index base oils along with a polymeric thickener produces a final fluid with a significantly high viscosity index. This allows the fluid to be used over a much wider operating temperature range than low viscosity index fluids, while maintaining an acceptable viscosity. In terms of hydraulic and lubricant applications, the fluid maintains the minimum required lubricating film thickness at higher temperatures, and resists thickening at lower temperatures, thereby extending the range at which it can still be pumped or circulated.

The readily biodegradable fluids described herein may be used in sensitive environments. Example applications are in the hydraulic systems of forestry and mining equipment as well as marine applications. The fluid may, however, be used in any common hydraulic system. Furthermore, the use of the fluid is not restricted to hydraulic applications. The fluids may be used as general industrial lubricants, process fluids, functional fluids or other fluids. Without restriction this may include applications such as: lubricants, process fluids, functional fluids, raw materials, coatings, cable fill compounds, defoamer oils, dust suppressant fluids, and other specialty fluids.

BRIEF DESCRIPTION OF THE DRAWINGS

FIG. 1 shows a schematic of an exemplary hydrotreating/hydrocracking and hydroisomerization process.

DETAILED DESCRIPTION OF PREFERRED EMBODIMENTS

The present disclosure relates to biodegradable fluids.

In preferred embodiments, the biodegradable fluids are readily biodegradable mineral oil based fluids. Preferred embodiments of the biodegradable fluids comprise highly refined, highly paraffinic mineral oils and polymeric thickener. Additional preferred embodiments of the biodegradable fluids may comprise highly refined, high viscosity base oils which are of lower paraffin content.

Mineral oil biodegradability is significantly impacted by degree of refining, with more severely refined mineral oil base fluids (base oils) showing higher levels of biodegradability. Preferred mineral oil base fluids used herein are prepared from highly paraffinic feedstocks having a high viscosity index (VI) and subjected to a severe hydrotreating/hydrocracking and hydroisomerization process. FIG. 1 shows a schematic of an exemplary hydrotreating/hydrocracking and hydroisomerization process. In the hydrotreating/hydrocracking process feedstocks are reacted with hydrogen in the presence of a catalyst at high temperatures (>300° C., but preferably near 400° C.) and high pressures (>2000 psi, but preferably near 3000 psi). The principle reactions occurring in this process are the 1) removal of unwanted polar compounds containing sulfur, nitrogen and oxygen, 2) conversion of aromatic hydrocarbons to saturated cyclic hydrocarbons and 3) the conversion of heavy poly-cyclo-paraffins into light, saturated hydrocarbons. The hydroisomerization process, operating in series with the hydrotreating/hydrocracking process employs an additional catalyst to selectively isomerize wax molecules (long chain n-paraffins present in the feedstock) to high viscosity index, low pour point isoparaffinic base oil molecules. The combined processes are capable of producing highly paraffinic base oils with viscosity indexes in excess of 130. The enhanced degree of refining is seen as an increased paraffin to cycloparaffin content and increased viscosity index (VI) (increased resistance to change in viscosity with change in temperature) in the given series of base oils. The preferred mineral oil base fluids show unexpectedly high levels of biodegradability as compared to similar viscosity grades of less refined mineral oil base fluids.

In preferred embodiments, one or more of the mineral oil base fluids making up the mineral oil base fluid portion of the biodegradable fluid contains at least 1:1 paraffins relative to cycloparaffins, with regard to wt %. In additional preferred embodiments, one or more of the mineral oil base fluids making up the mineral oil base fluid portion of the biodegradable fluid contains paraffins relative to cycloparaffins in at least a 3:2 ratio, with regard to wt %. In further preferred embodiments, the mineral oil base fluid portion of the biodegradable fluid includes one or more highly refined, high viscosity base oils which may be of lower paraffin content, or less than a 1:1 ratio of paraffins relative to cycloparaffins, with regard to wt %. In preferred embodiments, one or more of the mineral oil base fluids making up the mineral oil base fluid portion of the biodegradable fluid should have a VI of at least 110. In further preferred embodiments, the mineral oil base fluid portion of the biodegradable fluid further comprises one or more highly refined, high viscosity base oils having a viscosity index of less than 110. Different refining techniques may be used to prepare suitable base oil compositions that are expected to produce the same high levels of biodegradability of the base oils. A wide variety of highly paraffinic, high viscosity index feed sources are suitable for producing these highly biodegradable base oils. Preferred examples of the mineral oil base fluids include the mineral oil base fluids identified in Table 1 below as Mineral Oil Base Fluid A-E.

TABLE 1

| Mineral Oil Base Fluid | cSt @ 40° C. | cSt @ 100° C. | VI | kg/L@ 15° C. | ppm sulfur | wt % paraffins | wt % cycloparaffins | wt % aromatics |
|---|---|---|---|---|---|---|---|---|
| A - N100DW | 21.5 | 4.4 | 117 | 0.839 | <2 | 52.8 | 47.2 | <0.1 |
| B - N100VHVI | 21.3 | 4.5 | 128 | 0.832 | <1 | 60.9 | 39.1 | <0.1 |
| C - N100XV | 19.0 | 4.2 | 135 | 0.828 | <1 | 67.9 | 32.1 | <0.1 |
| D - N325DW | 52.5 | 8.2 | 128 | 0.846 | <1 | 51.7 | 48.3 | <0.1 |
| E - N650HT | 106 | 11.8 | 99 | 0.870 | <1 | 21.4 | 78.6 | <0.1 |

Preferred embodiments of the biodegradable fluids also include polymeric thickeners. A significant and unexpected synergy, in regards to increased biodegradability, can be obtained by blending mineral oils with selected polymeric thickeners. The level of biodegradability of the mineral oils and polymeric thickener alone is significantly lower than a mixture of both. This synergy from the polymeric thickener is wholly unexpected as the polymer itself shows low levels of biodegradability. Preferred examples of the polymeric thickeners include polymethacrylate thickeners. Polymethacrylate thickeners may be in the form of viscosity modifiers and pour point depressants. Other polymethacrylate additives such as anti-foaming additives can be included in the biodegradable fluids and also contribute to the unexpected synergy. Polymethacrylate thickeners typically include polymethacrylate at about 60-100 wt % and solvents and diluents at about 0-40 wt %.

Preferred embodiments of the biodegradable fluids may contain one or more additional, optional ingredients, such as antiwear additive, antioxidants, and corrosion inhibitors, in an amount of less than 5 wt %, preferably less than 2 wt %.

In preferred embodiments, the biodegradable fluids comprise about 80 to about 97 wt % of a mineral oil base fluid portion and about 3 to about 20 wt % of a polymeric thickener portion. In additional preferred embodiments, the mineral oil base fluid portion comprises one or more highly refined mineral oils having a ratio of paraffin content to cycloparaffin content of at least 3:2 and a viscosity index (VI) of at least 110. In further preferred embodiments, the mineral oil base fluid portion of the biodegradable fluid further comprises one or more highly refined, high viscosity mineral oils having less than a 1:1 ratio of paraffin content to cycloparaffin content and a viscosity index (VI) of less than 110. In further preferred embodiments, the polymeric thickener comprises polymethacrylate.

In preferred embodiments, the combination of highly refined mineral oils and select polymeric thickener allows the formulation of the present readily biodegradable mineral oil based fluids having a higher viscosity than can be achieved using a base oil blend alone. In particular, it is expected that the maximum viscosity of a readily biodegradable fluid blended from mineral oils alone would be approximately 22 cSt at 40° C. In preferred embodiments, the formulation of a readily biodegradable mineral oil based fluid has at least an ISO viscosity grade of 32 (28.8-35.2 cSt at 40° C.). In other preferred embodiments, the formulation of a readily biodegradable mineral oil based fluid has at least an ISO viscosity grade of 46 (41.4-50.6 cSt at 40° C.). The ability to formulate a higher viscosity fluid, while maintaining ready biodegradability, is key, as most industrial equipment requires higher viscosity oils in order to adequately protect moving parts with a hydrodynamic lubricating film.

Ready biodegradability, as measured by OECD (Organization for Economic and Co-operation and Development) 301B, is the breakdown or mineralization of at least 60% of an organic substance in 28 days when exposed to freshwater microorganisms. OECD 301B measures this breakdown or mineralization by monitoring the degree to which the organic carbon in a test substance is converted to carbon dioxide by the microorganisms.

Further aspects of the present invention will become apparent from the following description given by way of example only.

Example 1

Preferred examples (Formula 1, 2, 3, and 4) of the biodegradable fluids were prepared having the compositions set forth in Table 2 below.

TABLE 2

| Component | Description | Formula 1 | Formula 2 | Formula 3 | Formula 4 |
|---|---|---|---|---|---|
| | | ISO VG Class | | | |
| | | 32 wt % | 46 wt % | 46 wt % | 46 wt % |
| Base mineral oil | A - N100DW | | 46.43 | | |
| | B - N100VHVI | 64.18 | | 45.38 | 46.20 |
| | C - N100XV | | | | 9.72 |
| | D - N325DW | 31.30 | 29.80 | 29.83 | |
| | E - N650HT | | 18.73 | 19.74 | 39.05 |
| Performance Additive Package | Ashless Hydraulic Performance Package (LUBRIZOL AH93SA, Lubrizol, Wickliffe, OH) | 1.65 | 1.65 | 1.65 | 1.65 |
| Polymeric Thickener | Polymethacrylate Viscosity Modifier (Viscoplex 8-440, Evonik, Essen, Germany) - cSt @ 100° C. = 1250 | 2.43 | 2.95 | 2.95 | 2.95 |
| Polymeric Thickener | Polymethacrylate Pour Point Depressant (Viscoplex 1-153, Evonik, Essen, Germany) | 0.42 | 0.42 | 0.42 | 0.42 |
| Anti-foaming Additive | Polymethacrylate Anti-foamer (PC-1244, Allnex, Frankfurt, Germany) | 0.02 | 0.02 | 0.02 | 0.02 |

All components were blended together at a temperature between room temperature (about 20-22° C.) and 65° C. Preferably the temperature should be between 40° C. and 50° C. The mixing should be simple low to moderate shear mechanical mixing.

Table 3 below shows the Measured Biodegradability of Formulas 1-4 (OECD 301B-28 Day Biodegradability, wt %), the total weight percent of base mineral oil, in each formulation, and, for comparison, the expected biodegradability of the base oil portion. In each case, the exemplary biodegradable fluid (Formula 1-4) showed a biodegradability greater than expected based on the base mineral oil. Formulas 1, 3 and 4 demonstrated ready biodegradability.

TABLE 3

| | Formula 1 | Formula 2 | Formula 3 | Formula 4 |
|---|---|---|---|---|
| Measured Biodegradability, wt % | 62.8 | 58.8 | 75.2 | 79.0 |
| wt % Base Oil | 95.48 | 94.96 | 94.95 | 94.97 |
| Expected Biodegradability of Base Oil Portion | 49.0 | 35.9 | 44.1 | 48.6 |

Table 4 below shows compositions for additional preferred examples of the biodegradable fluids (Formulas 5, 6, and 7).

TABLE 4

| Component | Description | Formula 5 | Formula 6 | Formula 7 |
|---|---|---|---|---|
| | | ISO VG Class | | |
| | | 46 wt % | 46 wt % | 46 wt % |
| Base Mineral Oil | B - N100VHVI | 47 | 46 | 48.5 |
| | D - N325DW | 30 | 30 | 30 |
| | E-N650HT | 20 | 20 | 21.5 |
| Polymeric Thickener | Polymethacrylate Viscosity Modifier (Viscoplex 8-440, Evonik, Essen, Germany) - cSt @ 100° C. = 1250 | 3 | | |
| | Polymethacrylate Viscosity Modifier (Viscoplex 0-219, Evonik, Essen, Germany) - cSt @ 100° C. = 830 | | 4 | |

Table 5 below shows the Measured Biodegradability of Formulas 5-7 (OECD 301B—28 Day Biodegradability, wt %), the total weight percent of base mineral oil, in each formulation, and, for comparison, the expected biodegradability of the base oil portion. Tests were duplicated and results were averaged. Formulas 5 and 6 both showed higher biodegradability than what was expected. Formula 5 demonstrated ready biodegradability.

TABLE 5

| | Formula 5 | Formula 6 | Formula 7 |
|---|---|---|---|
| Measured Biodegradability, wt % | 75.3 | 53.0 | 34.1 |
| wt % Base Oil | 97 | 96 | 100 |
| Expected Biodegradability of Base Oil Portion | 45.2 | 44.6 | 46.6 |

What is claimed is:

1. A readily biodegradable fluid, comprising:

a mineral oil base fluid portion, wherein the mineral oil base fluid portion comprises one or more highly refined mineral oils having a ratio of paraffin content to cycloparaffin content of at least 3:2 and a viscosity index of at least 110; and a polymeric thickener portion, wherein the polymeric thickener portion comprises polymethacrylate, wherein the readily biodegradable fluid is readily biodegradable, and wherein a readily biodegradable fluid is readily biodegradable when at least 60% of organic carbon in the readily biodegradable fluid is converted to carbon dioxide in 28 days when exposed to freshwater microorganisms.

2. The readily biodegradable fluid of claim 1, wherein the readily biodegradable fluid comprises about 80 to about 97 wt % of the mineral oil base fluid portion and about 3 to about 20 wt % of the polymeric thickener portion.

3. The readily biodegradable fluid of claim 1, further comprising one or more highly refined, high viscosity mineral oils having a ratio of paraffin content to cycloparaffin content of less than 1:1 and a viscosity index of less than 110.

4. The readily biodegradable fluid of claim 1, wherein the readily biodegradable fluid has an ISO viscosity grade of 32.

5. The readily biodegradable fluid of claim 1, wherein the biodegradable fluid has an ISO viscosity grade of 46.

6. A method for preparing a readily biodegradable fluid, comprising:

preparing a mineral oil base fluid portion, wherein the mineral oil base fluid portion comprises one or more highly refined mineral oils having a ratio of paraffin content to cycloparaffin content of at least 3:2 and a viscosity index of at least 110; and mixing a polymeric thickener portion into the mineral oil base fluid portion, wherein the polymeric thickener portion comprises polymethacrylate, and wherein the mixing is carried out at a temperature of about 20° C. to about 65° C., to produce the readily biodegradable fluid, wherein the readily biodegradable fluid is readily biodegradable, and wherein a readily biodegradable fluid is readily biodegradable when at least 60% of organic carbon in the readily biodegradable fluid is converted to carbon dioxide in 28 days when exposed to freshwater microorganisms.

7. The method of claim 6, wherein the readily biodegradable fluid comprises about 80 to about 97 wt % of the mineral oil base fluid portion and about 3 to about 20 wt % of the polymeric thickener portion.

8. The method of claim 6, wherein the mineral oil base fluid portion further comprises one or more highly refined, high viscosity mineral oils having a ratio of paraffin content to cycloparaffin content of less than 1:1 and a viscosity index of less than 110.

9. The method of claim 6, wherein the readily biodegradable fluid has an ISO viscosity grade of 32.

10. The method of claim 6, wherein the readily biodegradable fluid has an ISO viscosity grade of 46.

* * * * *